US007261029B1

(12) United States Patent
Davis

(10) Patent No.: US 7,261,029 B1
(45) Date of Patent: Aug. 28, 2007

(54) FIREARM BOLT LOCKING MECHANISM

(76) Inventor: Douglas P. Davis, 8300 Beechwood Dr., Grand Bay, AL (US) 36541

( * ) Notice: Subject to any disclaimer, the term of this patent is extended or adjusted under 35 U.S.C. 154(b) by 0 days.

(21) Appl. No.: 11/415,080

(22) Filed: May 2, 2006

(51) Int. Cl.
*F41A 17/74* (2006.01)

(52) U.S. Cl. ..... 89/148; 89/138; 89/191.01; 42/16

(58) Field of Classification Search ..... 89/138, 89/137, 191.01; 42/1.05, 7, 16
See application file for complete search history.

(56) References Cited

U.S. PATENT DOCUMENTS

| | | | | |
|---|---|---|---|---|
| 1,980,874 | A | 11/1934 | Nickl | |
| 4,445,292 | A * | 5/1984 | Martin | 42/16 |
| 5,473,834 | A | 12/1995 | Bammate | |
| 5,588,241 | A | 12/1996 | Hurley | |
| 6,606,811 | B1 | 8/2003 | Olson | |
| 6,851,346 | B1 * | 2/2005 | Herring | 89/1.4 |
| 2003/0066226 | A1 | 4/2003 | Martin | |
| 2005/0000138 | A1 * | 1/2005 | Kiss | 42/50 |
| 2005/0011345 | A1 | 1/2005 | Herring | |
| 2005/0011346 | A1 | 1/2005 | Wolff et al. | |

* cited by examiner

*Primary Examiner*—Michael J. Carone
*Assistant Examiner*—Gabriel Klein
(74) *Attorney, Agent, or Firm*—Stephen R. Greiner

(57) ABSTRACT

A firearm bolt locking mechanism includes a locking pin in the bolt carrier of a firearm like an AK-47 assault rifle or variant thereof. The locking pin is normally urged from the bolt carrier by a compressed spring. The mechanism also includes a pivot arm mounted on the receiver cover of the firearm. The pivot arm has a spring-biased finger that normally fills a hole in the receiver cover. The mechanism further includes a magazine that stops the bolt of the firearm when the last cartridge from the magazine is fired and permits the spring to drive the locking pin into the hole. After replacing the empty magazine with a full one, the pivot arm is pressed to replace the locking pin in the hole with the finger and to release the bolt carrier to chamber a cartridge.

4 Claims, 4 Drawing Sheets

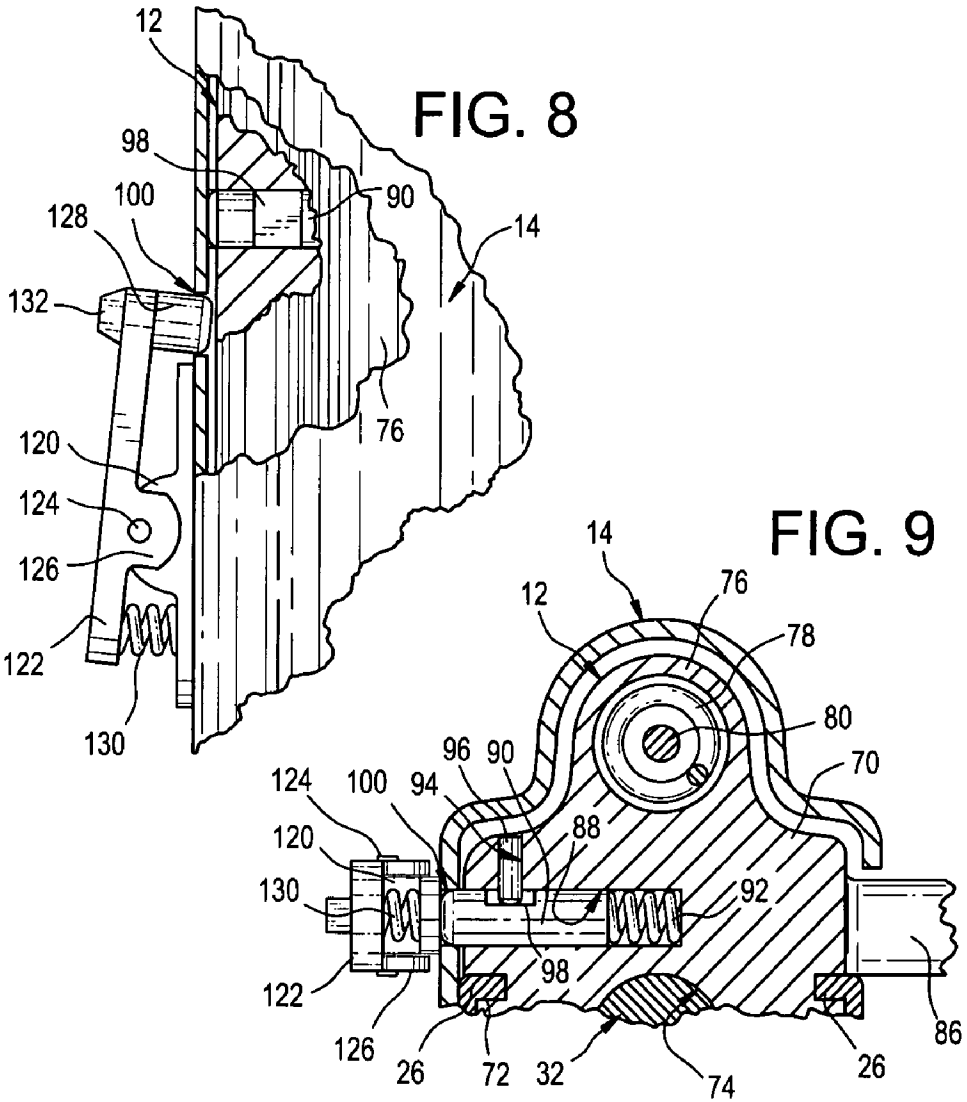
FIG. 8
FIG. 9
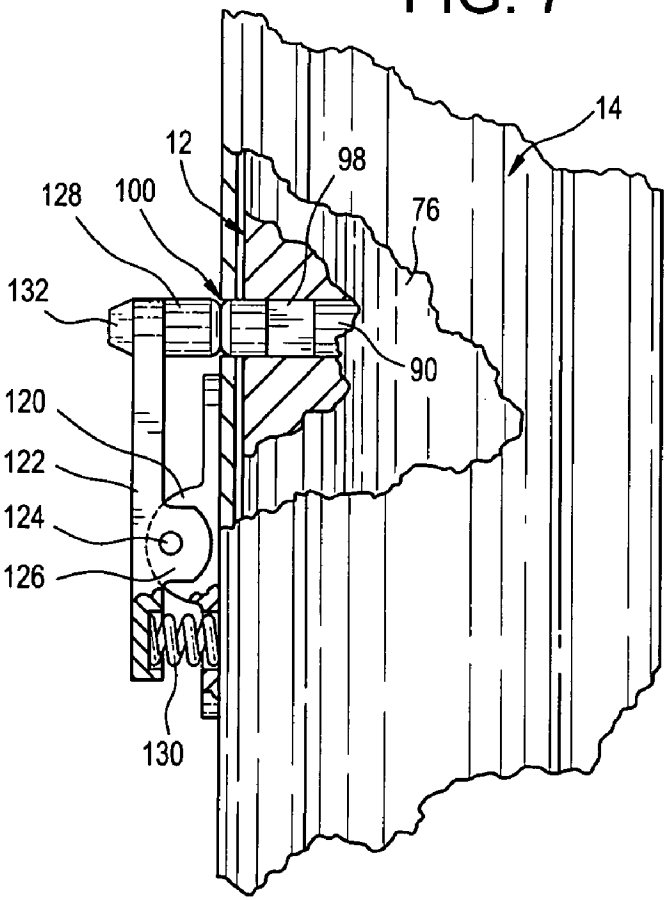
FIG. 7

FIREARM BOLT LOCKING MECHANISM

FIELD OF THE INVENTION

The present invention relates generally to ordnance and, more particularly, to automatic firing devices having interlocks between firing and cartridge feeding operations that lock a bolt open.

BACKGROUND OF THE INVENTION

The Kalashnikov assault rifle, better known as the AK-47, and its variants comprise one of the largest groups of firearms on earth. It has been estimated that over 90 million of these firearms have been produced in dozens of countries since their introduction in the Soviet Union in 1946. Developed primarily as a military weapon, the AK-47 became famous for its simplicity of operation and reliability in extreme conditions of use. Because of its mild recoil, the AK-47 has the capability of delivering effective full-automatic fire at a range of 300 meters.

The AK-47 has problems that make it less than optimal for use as a weapon of war. Perhaps the most significant problem is that the AK-47 lacks means to hold the bolt open after the last round is fired from its magazine. Thus, when an empty magazine is detached from the AK-47, the bolt carrier and bolt loudly slides to breech. Chambering another round requires that a loaded magazine be inserted into the receiver and the bolt carrier be pulled back. To pull the bolt carrier rearwardly, the AK-47 must be lowered from a firing position at the shoulder to develop sufficient leverage—a time-consuming and dangerous step in a war zone.

It is known to construct detachable firearm magazines such that they will retain a firearm bolt in an open position when all of the cartridges in the magazine have been discharged therefrom with magazines recently adopted by the Yugoslavian Army and recently introduced into the United States being an example. The Yugoslavian magazines serve to permit inspection of the firing chamber and alert the user to the fact that they are empty. Nonetheless, such do not prevent the forward movement of the bolt carrier and bolt when detached from the AK-47. Thus, reloading an AK-47 outfitted with Yugoslavian magazines still requires that the shooter drop the firearm from a firing position to pull the bolt carrier rearwardly so as to chamber the first round.

SUMMARY OF THE INVENTION

In light of the problems associated with rapidly loading an AK-47 assault rifle and its variants in wartime conditions, it is a principal object of the present invention to provide a firearm bolt locking mechanism that retains the bolt carrier and bolt of an AK-47, or variant thereof, in a recoiled position while exchanging a full magazine for an empty one after which a cartridge can be immediately chambered and fired.

It is an additional object of the invention to provide a mechanism of the type described that offers "push-button" actuation so that an AK-47 assault rifle, or variant thereof, need never leave the firing shoulder of a shooter while exchanging a full magazine for an empty one. Thus, the speed of exchanging magazines and the firepower of the shooter substantially increases.

It is a further object of the invention to provide a mechanism of the type described that can be incorporated into an AK-47 assault rifle, or variant thereof, at the time of manufacture of the rifle or can be supplied in the form of a kit featuring: a receiver cover, a bolt carrier, and a magazine of improved construction.

Still another object of the invention is to provide a mechanism of the type described that will not interfere with normal operation of an AK-47 or variant thereof. Thus, a firearm equipped with the mechanism specified herein will function normally except that reloading is simplified and speeded-up by temporarily locking the bolt carrier in a recoiled position after firing the last round from the magazine.

It is an object of the invention to provide improved features and arrangements thereof in a firearm bolt locking mechanism for the purposes described that is lightweight in construction, inexpensive to manufacture, and fully dependable in use.

Briefly, the locking mechanism in accordance with this invention achieves the intended objects by featuring a bolt carrier for moving a bolt within the receiver of a firearm. The bolt carrier includes a base block for slidably engaging the receiver. The base block has a longitudinal bore in the bottom thereof for carrying the bolt. The base block also has a lateral bore positioned above the longitudinal bore and oriented at right angles thereto. An elongated, tubular sleeve is affixed atop the base block for receiving the recoil spring and the spring guide of a firearm therein. The tubular sleeve is adapted to carry a gas-piston at its front. A slotted guideway is disposed forwardly of the longitudinal bore and beneath the sleeve for receiving a stud extending from the bolt. A charging handle is affixed to the guideway and extends therefrom. A locking pin is slidably disposed in the lateral bore. A first compressed spring is disposed in the lateral bore for normally extending the locking pin from the lateral bore.

The firearm bolt locking mechanism also includes a receiver cover having a top wall with a first hole adapted to receive therein the locking pin of the bolt carrier. A back wall is affixed to top wall and has a second hole for receiving the base of the spring guide. A pivot block is affixed to the top wall adjacent the first hole. A pivot arm is pivotally secured to the pivot block. A finger extends inwardly from the pivot arm and being adapted for insertion into the first hole.

The foregoing and other objects, features, and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which:

FIG. 7 is a top view of the firearm with portions broken away and revealing the locking pin of the improved bolt carrier situated within the pin-receiving aperture in the receiver cover.

FIG. 8 is a top view of the firearm with portions broken away and revealing the locking pin of the improved bolt carrier remote from the pin-receiving aperture.

FIG. 9 is a cross-sectional view of the firearm taken along line 9-9 of FIG. 2.

Similar reference characters denote corresponding features consistently throughout the accompanying drawings.

DETAILED DESCRIPTION OF THE PREFERRED EMBODIMENT

Figure 1:
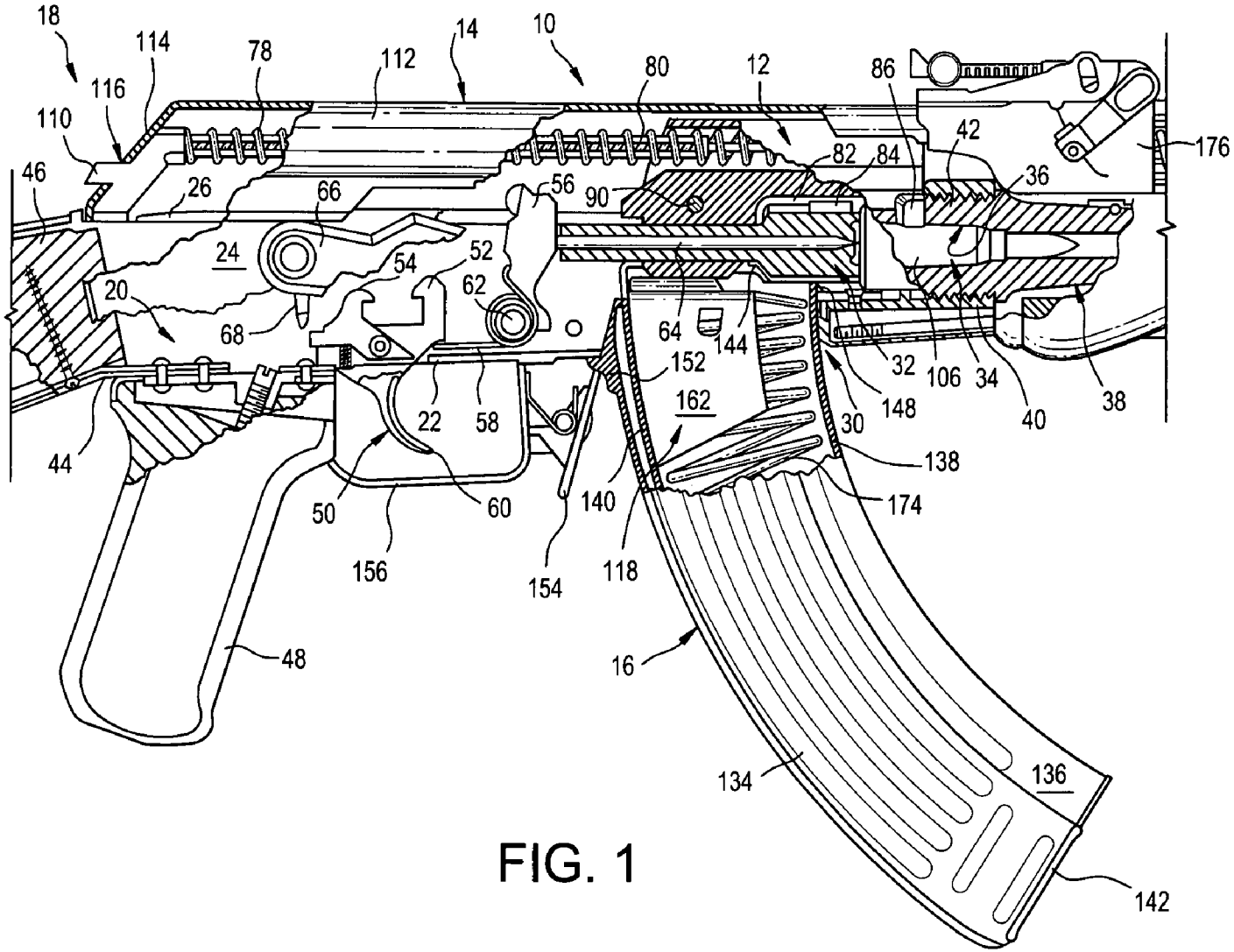
FIG. 1 is a side view of a firearm incorporating the bolt locking mechanism of the present invention with portions broken away to reveal details thereof and wherein the bolt is retaining a cartridge in the firing chamber.
Figure 2:
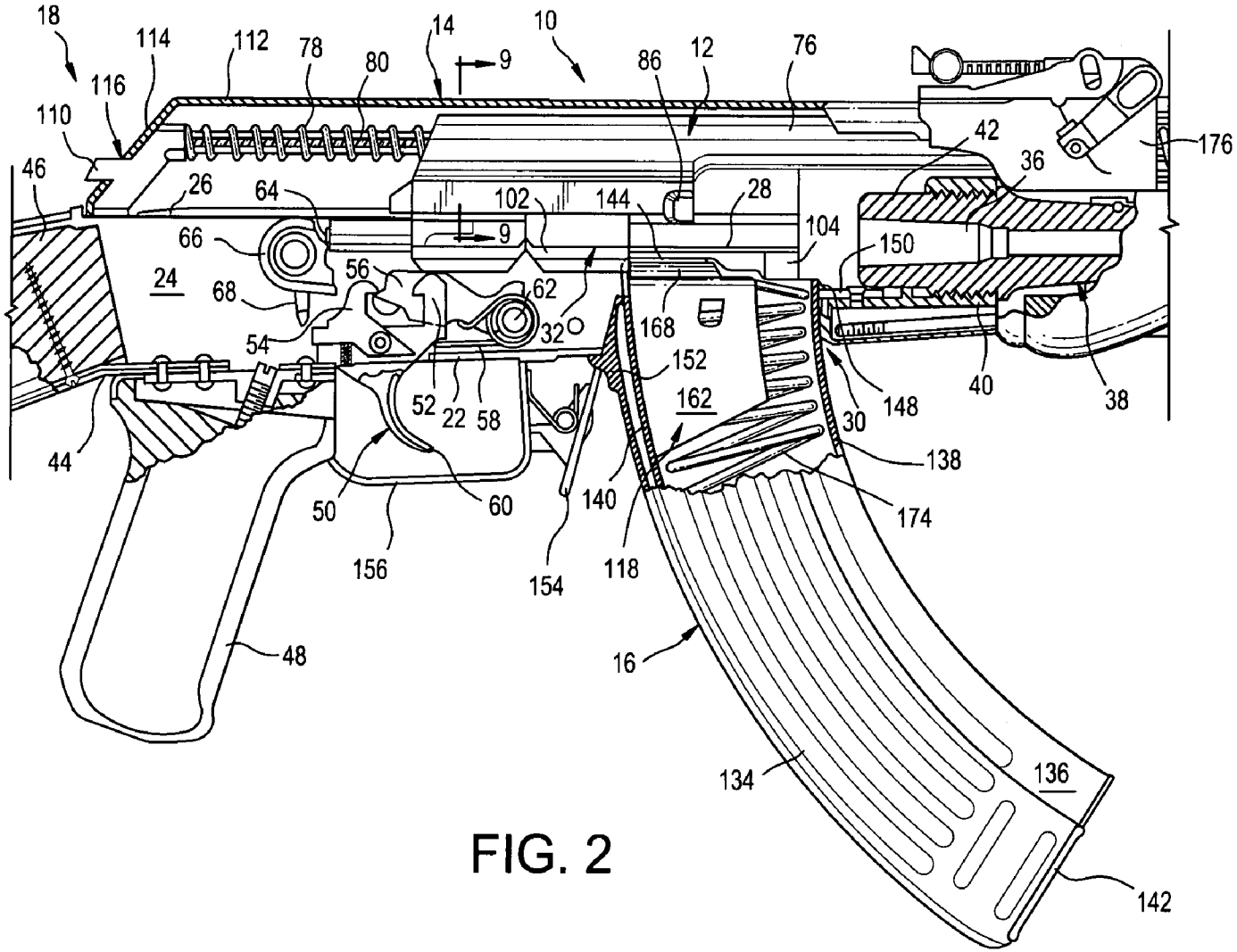
FIG. 2 is a side view of the firearm of FIG. 1 with portions broken away to reveal details thereof and wherein the bolt is engaged with the follower in the empty magazine.
Figures 3, 4, 5, 6:
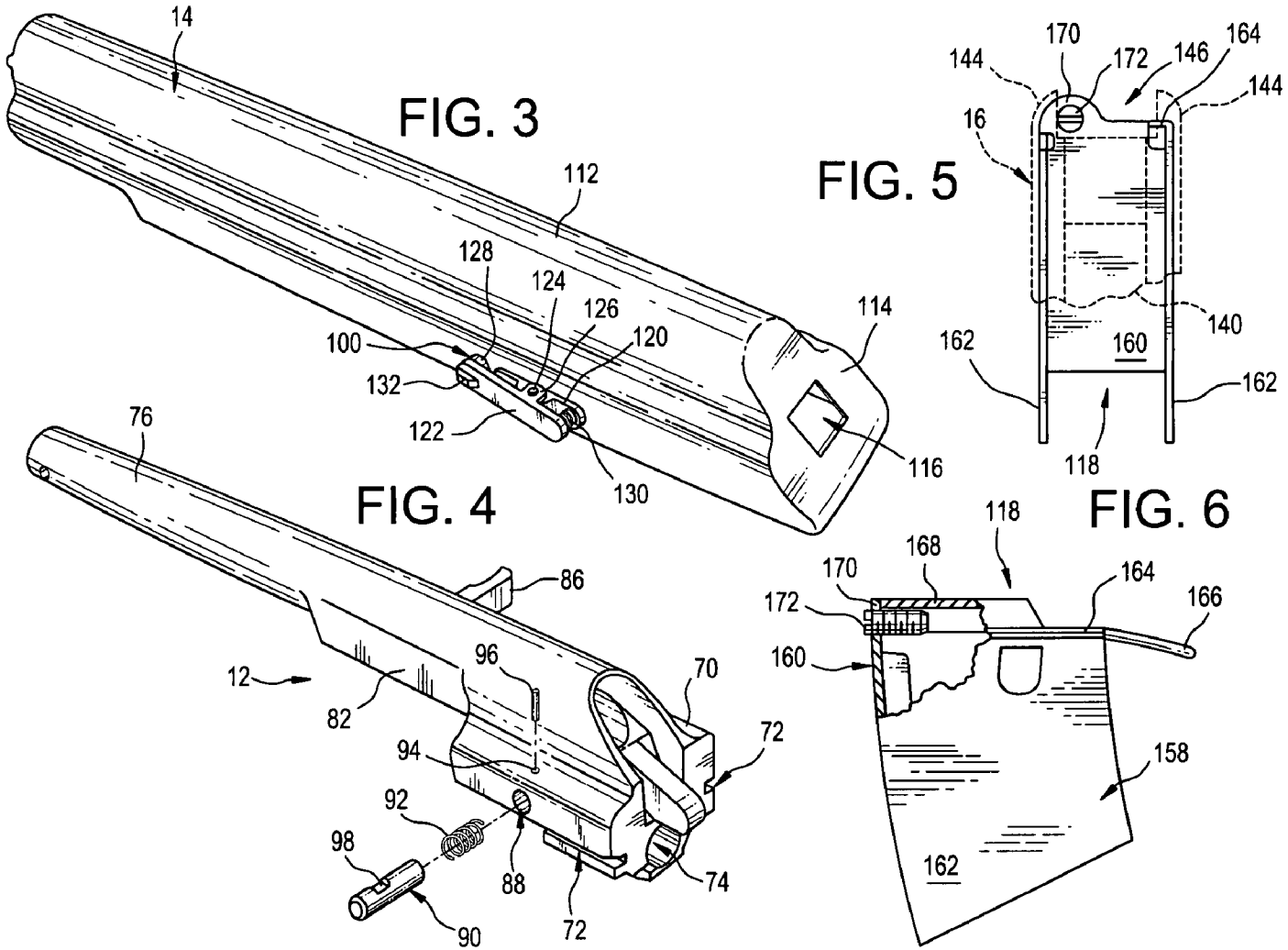
FIG. 3 is a perspective view of the improved receiver cover of the locking mechanism.
FIG. 4 is an exploded perspective view of the improved bolt carrier of the locking mechanism.
FIG. 5 is a rear view of the improved magazine follower of the locking mechanism.
FIG. 6 is a side view of the magazine follower of FIG. 5.

Referring now to the FIGS., a firearm bolt locking mechanism in accordance with the present invention is shown generally at 10. Mechanism 10 comprises a bolt carrier 12, a receiver cover 14 and a magazine 16 of improved construction. All are utilized within an AK-47 assault rifle, or variant thereof, hereinafter referred to as a firearm 18. Since firearm 18 is well known to those of ordinary skill in the art, its description will not be belabored hereinbelow. Nonetheless, sufficient detail will be provided so that a reader will gain a full understanding of the manner in which mechanism 10 is made and used within firearm 18.

Firearm 18 includes a receiver 20 having a bottom wall 22 from the opposite sides of which a pair of side walls 24 extend upwardly. A pair of bolt carrier guides 26 is provided to receiver 20 by bending inwardly the tops of side walls 24. Bolt guides 28 are affixed to the inner surfaces of side walls 24 beneath guides 26. Magazine well 30 is a rectangular opening in bottom wall 22 for capturing magazine 16 at a height sufficient to permit bolt 32 to strip a cartridge 34 from magazine 16 and push cartridge 34 into firing chamber 36 in barrel 38.

A front trunnion 40 is affixed within the front of receiver 20 for securing barrel 38 to receiver 20. The breech 42 of barrel 38 is threaded for rotation within trunnion 40. Trunnion 40 is, in turn, riveted to receiver 20. Breech 42 of barrel 38 is also chamfered to guide a cartridge 34 into firing chamber 36.

A rear trunnion 44 is affixed to the rear of receiver 20 for the attachment of stock 46. Stock 46 is formed of plastic or wood. A pistol grip 48 is secured to bottom wall 22 forwardly of stock 46 and is also formed of plastic or wood.

The trigger assembly of firearm 18 includes: a trigger 50, a sear 52, a disconnector 54, a hammer 56, and a trigger/hammer spring 58. As shown, trigger 50 has a finger lever 60 and integral sear 52 that engages hammer 56. When finger lever 60 is pulled rearwardly against the force of spring 58, wound around hammer retaining pin 62, sear 52 tilts forwardly so that it disengages hammer 56. Hammer 56, then, rotates forward to strike firing pin 64 extending longitudinally through bolt 32.

Disconnector 54 is a hook pivotally secured to the rear of finger lever 60. As bolt 32 passes over hammer 56 during recoil, and forces hammer 56 to rotate downwardly to a cocked position, disconnector 54 momentarily engages hammer 56 and holds hammer 56 until the shooter releases trigger 50. This allows sear 52 to rotate backwardly to catch hammer 56 and hold such until trigger 50 is pulled again. Disconnector 54, thus, makes certain that another cartridge 34 cannot be fired until trigger 50 is both released and pulled.

A fire selector lever 66 is located on the side of receiver 20 and is secured to a safety block 68 positioned within receiver 20. When lever 66 is pushed into its uppermost "safe" position, safety block 68 pivots forwardly to prevent trigger 50 from moving enough to allow sear 52 to release hammer 56. In its middle position, block 68 permits automatic fire and in its lowermost position, block 68 permits single shots.

The gas-operated action of firearm 18 includes bolt carrier 12 that transports bolt 32 within receiver 20. Bolt carrier 12 includes a base block 70 having grooves 72 in its opposite sides for slidably engaging carrier guides 26 and a longitudinal bore 74 in its bottom for carrying bolt 32. Formed atop block 70 is an elongated, tubular sleeve 76 for receiving recoil spring 78 and spring guide 80 therein. Beneath sleeve 76 and forwardly of bore 74, bolt carrier 12 is provided with a slotted guideway 82 that receives a stud 84 extending from bolt 32. A charging handle 86 is affixed to guideway 82 and reciprocates outside of receiver 20 when firearm 18 is fired.

Base block 70 is provided with a lateral bore 88 above one of grooves 72 and below sleeve 76 that passes about halfway through base block 70. A locking pin 90 is slidably positioned in bore 88. Locking pin 90 is biased to normally project from bore 88 by a coiled, compressed spring 92 disposed between the inner end of bore 88 and the inner end of locking pin 90. The outer end of pin 90 is rounded so as to minimize friction between pin 90 and receiver cover 14 that it engages during use of firearm 18.

Base block 70 is provided with a vertical bore 94 that intersects lateral bore 88 proximate the midpoint of lateral bore 88. A retaining pin 96 is inserted into bore 94 so as to extend into a notch 98 provided in the top of locking pin 90 thereby preventing locking pin 90 from becoming inadvertently detached from bolt carrier 12. Notch 98 is so configured that pin 90 can, in one position, be fully retracted into bore 88 and, in another position extend from block 70 and into a hole 100 provided in receiver cover 14. Retaining pin 96 is affixed within bore 94 by any suitable means.

Firearm 18 fires from a closed-bolt position meaning that bolt 32 is locked against breech 42 prior to firing. Bolt 32 is locked into place by lugs 102 that are rotated into seats 104 machined into trunnion 40. Bolt 32 is also constructed so that on the unlocking rotation, it extracts the fired cartridge casing from firing chamber 36. To do this, however, bolt lugs 102 must be rotated out of seats 104 to unlock bolt 32. This is accomplished by a guideway 82 on bolt carrier 12 engaging a cooperating stud 84 on bolt 32 that disengages bolt lugs 102 once backward motion is started.

Once bolt 32 is unlocked, the entire bolt carrier 12 and bolt 32 move back against the pressure of a recoil spring 78, riding over hammer 56 while at the other end a fired cartridge casing 106 is withdrawn and ejected from firearm 18 as breech 42 opens. The force of recoil spring 78 eventually overcomes the backward motion of bolt carrier 12 and starts bolt carrier 12, bolt 32 and gas piston 108, carried at the front of bolt carrier 12, forward. As bolt 32 moves forward, it catches the next cartridge 34 and strips such from magazine 16 and, then, drives cartridge 34 forward into breech 42. Here, bolt 32 stops against breech 42, but carrier 12 and piston 108 continue for enough distance to enable guideway 82 and stud 84 to perform rotational locking and, thus, secure bolt 32 for the firing of the next cartridge 34. Interestingly, a recoil spring base 110 at the rear end of spring guide 80 also serves as a lock for receiver cover 14.

Receiver cover 14 includes a top wall 112 having a configuration resembling an inverted "U" and a sloping back wall 114 affixed to top wall 112. The opposite sides of wall 112 bulge outwardly at their bottoms to provide clearance for block 70. Strengthening ribs (not shown) can be provided along the sides of wall 112. A rectangular hole 116 is provided in back wall 114 for receiving recoil spring base 110. Also, hole 100 is provided in wall 112 at a position where pin 90 is axially aligned therewith, and pin 90 can pass into hole 100 under the urging of spring 92, when bolt 32 is captured by a follower 118 of magazine 16 as described further hereinbelow.

A pivot block 120 is affixed to top wall 112 adjacent hole 100. A pivot arm 122 is secured to block 120 by means of a pivot pin 124 passing through the centers of pivot block 120 and a pair of retaining tabs 126 extending from arm 122 and respectively positioned above and below pivot block 120. A finger 128 extends inwardly from the front of pivot arm 122 and is adapted for insertion into hole 100. Finger 128 is normally urged into hole 100 by a compressed spring 130 disposed between the rear of pivot arm 122 and top wall 112.

Springs 92 and 130 are balanced in terms of the force that they exert such that, when pin 90 and finger 128 are set in axial alignment on opposite sides of hole 100 as when bolt 32 is captured by magazine follower 118, the force exerted by pin 90 upon finger 128 is sufficient to permit pin 90 to enter hole 100 and drive finger 128 therefrom. With the addition of light pressure from the hand of a shooter applied to the locator button 132 provided at the front of pivot arm 122, pin 90 is easily driven from hole 100 and back into bolt carrier block 70. The force exerted by spring 92 on locking pin 90 is insufficient to drive pin 90 into hole 100 when bolt carrier 12 is experiencing a recoil movement after firing cartridge 34. Under such a condition, pin 90 "jumps over" hole 100.

Firearm 18 is fed from magazine 16 that includes an elongated, yet curved, housing 134 for storing thirty cartridges 34 in stacked, double rows. Housing 134 is made from two pieces of sheet steel shaped so as to provide housing 134 with a pair of arcuate side walls 136 connected in opposition by a front wall 138 and a back wall 140. Housing 134 is closed at its bottom by a bottom wall 142 that is connected about its periphery to the bottoms of walls 136, 138 and 140.

A pair of projections 144 is affixed to the tops of side walls 136 and extend upwardly therefrom. Projections 144 are curved inwardly toward one another so as to define a pair of feed lips for releasably retaining cartridges 34 in magazine 16. Projections 144 also define a longitudinal channel 146 between one another at the open top of housing 134.

A grooved lug 148 is affixed to the top of front wall 138 for receiving a cooperating rib 150 extending inwardly into magazine well 30 in receiver 20. A catch 152 is affixed to back wall 140 for releasable engagement with a spring-biased magazine latch 154 positioned in front of trigger guard 156.

Magazine 16 is inserted into magazine well 30 by tipping housing 134 forward so that rib 150 slips into lug 148. Then, magazine 16 is pulled to the rear to snap catch 152 into place above latch 154. Magazine 16 is removed by pressing latch 154 toward housing 134 and, then, swinging magazine 16 forward and out of magazine well 30.

Follower 118 is slidably positioned within housing 134 and is made of two pieces 158 and 160 of sheet steel. Piece 158 has a pair of guide plates 162 that slide against the inner surfaces of side walls 136 and that are connected together at their tops by a crosspiece 164. Crosspiece 164 has a ledge 166 that projects forwardly of guide plates 162 and directs cartridges 34 smoothly from magazine 16 into breech 42. Piece 160 is affixed to the rear ends of guide plates 162 and the bottom of crosspiece 164 for reinforcement purposes.

One side of crosspiece 164 is bowed or arched upwardly so as to form a longitudinal ridge 168 that not only ensures that cartridges 34 compactly stack in double rows within housing 134 but extends upwardly to such an extent that it catches the bottom of bolt 32 when bolt 32 is returning toward breech 42 after firing the last cartridge 34 from magazine 16.

Piece 160 is provided with a semi-circular tab 170 that projects upwardly with ridge 168. Tab 170 is penetrated by a setscrew 172 that is threadably engaged therewith and is capable of engagement with bolt 32. By rotating setscrew 172 with a suitable tool, such may be caused to extend rearwardly from piece 160 so as to finely adjust the position of bolt carrier 12 forwardly or rearwardly to ensure perfect alignment of locking pin 90 with hole 100 in receiver cover 14 when bolt 32 is captured or stopped by follower 118.

A compressed, coiled spring 174, positioned between crosspiece 164 and bottom wall 142, urges follower 118 upwardly to position and hold cartridges 34 against projections or feed lips 144 and within channel 146 for sequential withdrawal by bolt 32. It should be appreciated that when the last cartridge 34 is fired, follower 118 is urged upwardly by spring 174 to the highest elevation permitted by projections or feed lips 144, i.e., the one at which the top of ridge 168 abuts the bottom of one of projections 144. At this elevation, setscrew 172 is positioned within channel 146 and is capable of engaging bolt 32.

Magazine 16 is loaded by placing a cartridge 34 between the projections or feed lips 144 and pressing downwardly against the force of spring 174 until it snaps beneath projections or lips 144. This step is repeated until magazine 16 receives thirty cartridges 34. When full, magazine 16 will accept no more cartridges 34. Provided that setscrew 172 is not unscrewed too far from tab 170 to engage housing 134, setscrew 172 will have no effect on the loading of magazine 16.

A magazine of the sort described hereinabove was developed for use by the Yugoslavian Army and was introduced in the United States last year. The Yugoslavian magazine, however, lacks the fine adjustment capabilities provided by setscrew 172.

The action of firearm 18 depends on the flow of propellant gas from barrel 38 to the face of gas piston (not shown) affixed to the front of bolt carrier 12. Firing gasses are diverted via a backwards-facing vent (not shown) to a gas-cylinder 176 mounted atop barrel 38. In gas-cylinder 176, gasses impinge on the front of the gas piston, driving the piston backwards. Bolt 32 is linked to bolt carrier 12; so, as carrier 12 and the piston recoil, bolt 32 moves with them in preparation of firing another cartridge 34. If the last cartridge 34 has been discharged from magazine 16 and fired, bolt 32 will be captured by magazine follower 118.

Assuming that magazine 16 has been emptied and bolt 32 has been captured by follower 118 thereby causing locking pin 90 to be positioned in hole 100, firearm 18 is reloaded by squeezing latch 154 toward empty magazine 16 and pivoting empty magazine 16 from magazine well 30. A full magazine 16, containing thirty cartridges, is repositioned in well 30 by reversing the removal step. Now, by pressing pivot arm 122 to cause finger 128 to urge pin 90 from its locked position in hole 100 to its released position outside of hole 100, spring 78 drives bolt carrier 12 forwardly so that the bottom of bolt 32 strips a cartridge 34 from magazine 16 and into firing chamber 36, ready to fire. The entire reloading process requires just seconds to complete and can be accomplished by a shooter without removing firearm from a firing position at his shoulder or removing his eyes from a target.

It should be noted that mechanism 10 is versatile. Thus, if a shooter desires to use standard magazines that will not capture bolt 32, he can manually draw the bolt carrier 12 rearwardly by pulling upon handle 86 to fit locking pin 90 in hole 100. Then, after placing a full, standard magazine in well 30, he can press button 132 to release locking pin 90 and cause bolt 32 to chamber a cartridge 34. Such an approach to loading/reloading permits the shooter to have firearm 18 immediately at the ready for firing when the relatively loud sound of a cartridge being chambered is emitted from firearm 18 possibly alerting targets that may, themselves, be armed.

While the locking mechanism has been described with a high degree of particularity, it will be appreciated by those skilled in the art that modifications can be made to it. For example, bolt carrier 12 and receiver cover 14 can be employed together in a firearm without magazine 16, though locking pin 90 must be manually set in hole 100 for locking to occur. Therefore, it is to be understood that the present invention is not limited to the sole embodiment of a locking mechanism described above, but encompasses any and all embodiments within the scope of the following claims.

I claim:

1. A firearm bolt locking mechanism, comprising:

a bolt carrier for moving a bolt within the receiver of a firearm, said bolt carrier including:

a base block for slidably engaging said receiver, said base block having a longitudinal bore in the bottom thereof for carrying the bolt, said base block also having a lateral bore being positioned above said longitudinal bore and being oriented at right angles thereto;

an elongated, tubular sleeve being affixed atop said base block for receiving the recoil spring and the spring guide of a firearm action therein, said tubular sleeve being adapted to carry a gas-piston at its front;

a slotted guideway being disposed forwardly of said longitudinal bore and beneath said sleeve for receiving a stud extending from the bolt;

a charging handle being affixed to said guideway and extending therefrom;

a locking pin being slidably disposed in said lateral bore; and, a first compressed spring being disposed in said lateral bore for normally extending said locking pin from said lateral bore; and, a receiver cover for covering the receiver of the firearm, said receiver cover including:

a top wall having a first hole adapted to receive therein said locking pin of said bolt carrier;

a back wall affixed to top wall and having a second hole for receiving the base of the spring guide;

a pivot block being affixed to said top wall adjacent said first hole;

a pivot arm being pivotally secured to said pivot block; and, a finger extending inwardly from said pivot arm and being adapted for insertion into said first hole.

2. The firearm bolt locking mechanism according to claim 1 further comprising a magazine, said magazine including:

a housing for storing a plurality of cartridges, said housing having an open top and a pair of inwardly directed feed lips bounding said open top;

a grooved lug being affixed to the front of said housing for receiving a cooperating rib extending from the receiver;

a catch being affixed to the back of said housing for releasably engaging a spring-biased magazine latch extending from the receiver;

a follower being slidably positioned within said housing, said follower having a longitudinal ridge in the top thereof for urging cartridges positioned within said housing upwardly into engagement with said feed lips, said longitudinal ridge being adapted to catch the bolt of the firearm when said magazine is empty of cartridges;

a setscrew, penetrating the back of said follower and said longitudinal ridge thereof, for variably spacing said bolt from said longitudinal ridge; and, a second compressed spring being disposed between the bottom of said housing and said follower for urging said follower upwardly toward said feed lips.

3. The firearm bolt locking mechanism according to claim 1 wherein:

said locking pin further includes a notch in its top;

said base block further includes a vertical bore that intersects said lateral bore; and, said bolt carrier further includes a retaining pin being secured within said vertical bore so that its bottom is fitted within said notch so as to prevent the removal of said locking pin from said lateral bore.

4. The firearm bolt locking mechanism according to claim 1 wherein said receiver cover further includes a third compressed spring for urging said finger into said hole.

* * * * *